US006178865B1

(12) United States Patent
Roberts

(10) Patent No.: US 6,178,865 B1
(45) Date of Patent: Jan. 30, 2001

(54) THERMALLY MASSIVE RADAR DECOY

(75) Inventor: Thomas G. Roberts, Huntsville, AL (US)

(73) Assignee: The United States of America as represented by the Secretary of the Army, Washington, DC (US)

( * ) Notice: Under 35 U.S.C. 154(b), the term of this patent shall be extended for 0 days.

(21) Appl. No.: 06/481,130

(22) Filed: Mar. 23, 1983

(51) Int. Cl.[7] ..... B64C 1/10; G01J 5/02

(52) U.S. Cl. ..... 89/36.01; 244/1; 244/117 A; 244/121; 250/352; 374/129

(58) Field of Search ..... 89/36.01, 36.05, 89/36.11, 36.12, 1.11; 250/495.1, 339, 352; 244/1, 121, 117 A; 374/129

(56) References Cited

U.S. PATENT DOCUMENTS 2,300,067 * 10/1942 Schwab ..... 89/36.12
3,219,826 * 11/1965 Letaw, Jr. ..... 244/3.16
3,694,624 * 9/1972 Buchta ..... 250/495.1
3,944,167 * 3/1976 Figler et al. ..... 250/339
4,323,012 * 4/1982 Driver, Jr. ..... 102/489
4,439,767 * 3/1984 Hefley et al. ..... 89/36.01
4,609,034 * 9/1986 Kosson et al. .
4,801,113 * 1/1989 Engelhardt .

* cited by examiner

*Primary Examiner*—Stephen C. Buczinski
(74) *Attorney, Agent, or Firm*—Arthur H. Tischer; Freddie M. Bush

(57) ABSTRACT

A light weight decoy for deceiving radar and forward looking infrared tracking systems. The decoy provides the same radar cross-section as that of an intercontinental ballistic missile (ICBM) and is thermally massive across the entire black body spectrum. Thermal massiveness is accomplished by measuring the temperature of the decoy outer surface and the temperature of the space surrounding the decoy, obtaining the differential temperature, and radiating heat within the decoy to maintain the surface thereof at a temperature similar to that of an ICBM.

8 Claims, 1 Drawing Sheet

THERMALLY MASSIVE RADAR DECOY

DEDICATORY CLAUSE

The invention described herein may be manufactured, used, and licensed by or for the Government for governmental purposes without the payment to me of any royalties thereon.

BACKGROUND OF THE INVENTION

When an intercontinental ballistic missile (ICBM) is launched into an orbit toward a target, it can be readily detected by radar as it approaches a target area. Several decoy missiles, which are designed to appear to a radar system as though they are ICBM's, may accompany one or more ICBM's so that a cluster of missiles will appear to a tracking radar, thereby camouflaging the identity of the true ICBM's. However, this cluster of missiles is also being observed by detection systems other than radar. For example, passive infrared detection systems such as forward looking infrared systems (FLIRS) in the 3–5 micron band and the 8–14 micron band are used. These systems sense the temperature of an object by observing the thermal energy which it radiates. Thus, when an ICBM and accompanying decoys are launched into a polar orbit they will pass from a sun lit region into a region shaded by the earth's shadow. When this happens, both the massive ICBM's and any decoys which accompany them begin to radiate energy to the cold regions of outer space and begin to cool down. Since each radiates energy at about the same rate, the ICBM's with their large thermal mass tend to change temperature very slowly. However, the light weight decoys, because of their small thermal mass, change temperature very rapidly by comparison, allowing the FLIRS to quickly discriminate between the ICBM's and the decoys.

SUMMARY OF THE INVENTION

A light weight decoy for deployment in the vicinity of an ICBM for deceiving radar and FLIR tracking systems. The decoy is thermally massive across the entire black body spectrum, providing the same radar cross-section and thermal cross-section as that of an ICBM. A thermal source within the decoy causes it to cool at the same rate as the ICBM which it represents. The temperature of the decoy's outer surface is measured and compared with the temperature of the space surrounding the decoy. A differential temperature is obtained and heat is generated within the decoy to maintain the surface thereof at a temperature similar to that of an ICBM. Two temperature sensors, and a microcomputer provide the differential signal which drives a current control device to supply electrical power to a resistance heater for generating the heat at a variable rate.

DESCRIPTION OF THE PREFERRED EMBODIMENT

Figure 1:
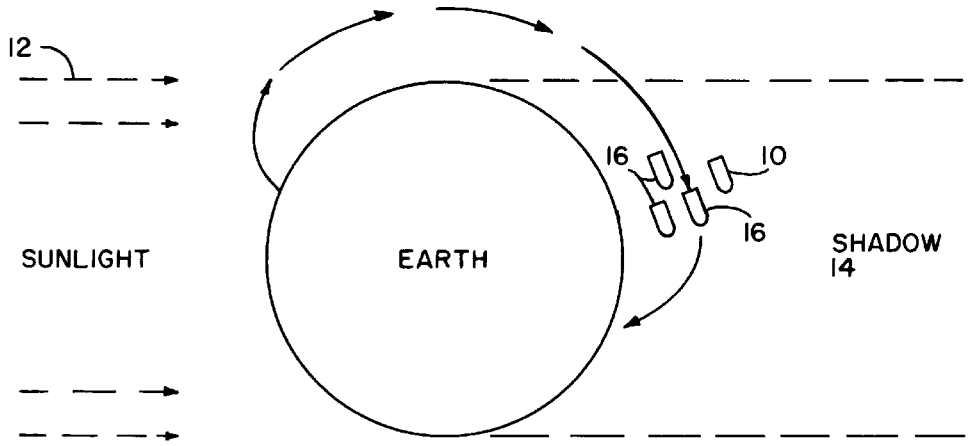
FIG. 1 is a simplified drawing of an object in a polar orbit or flight path.

Referring now to the drawings wherein like numerals refer to like parts in each figure, FIG. 1 discloses objects in a polar flight path. When an object such as a missile 10 is in a polar orbit or flight path around the earth and passes out of sunlight 12 into the earth's shadow 14, energy will be radiated away from the object to outer space. For a worst case treatment of the energy that is radiated away during the time (20 seconds for example) that an ICBM 10 or a decoy 16 may be observed by tracking sensors, it is assumed that one or more decoys 16 and ICBM 10 enter the shadow region of outer space 14 wherein the temperature is zero degrees Kelvin (° K) from a sunny region where the temperature is 300° K. For this case the power radiated from the surface of a missile or decoy, per unit surface area, is $$W=\sigma(\Delta T)^4 \tag{1}$$

where W is power, σ is the Stefan-Boltzmann constant $-\sigma=5.67\times10^{-8}$ watts/(meter)$^2$ per degrees Kelvin and ΔT is the temperature difference. The surface area, A, of an ICBM or decoy is approximately 4 (meters)$^2$. Therefore the total power ($W_T$) being radiated away by a black body in this worst case is $$W_T=(\Delta T)^4 A. \tag{2}$$

The Heat content, Q, of an ICBM or Decoy is given by $$Q=Mc\Delta T, \tag{3}$$

where M is the mass of the decoy or ICBM, c is the specific heat in units of Joules (J) per Killogram (Kg) per degrees Kelvin (° K), and ΔT is the temperature difference. The value of c for these objects is approximately $10^3$ J/Kg ° K. The change in temperature with time of one of these objects is obtained by differentiating equation (3) with respect to time. Thus $$\frac{dQ}{dt} = Mc\frac{d(\Delta T)}{dt}; \tag{4}$$

or, since the temperature of outer space has been taken to be zero ° K $$\frac{dQ}{dt} = Mc\frac{dT}{dt}. \tag{5}$$

However, $$\frac{dQ}{dt} = W_T. \tag{6}$$

Thus, equations (2) and (4) can be combined to provide:

$$\frac{d(\Delta T)}{dt} = \frac{\sigma A(\Delta T)^4}{Mc} \tag{7}$$

Equation (7) discloses that the rate of change of temperature is proportional to the inverse of the mass. Thus, the light weight decoys cool at a rate which is more than ten times faster than the massive ICBMs.

The maximum energy radiated away by an ICBM during the first twenty seconds in the shadow region is given by $$\Delta Q=W_T(t)=\sigma A\ \Delta T^4\ t, \tag{8}$$

therefore $$\Delta Q=(5.67)(10^{-8})(4)(300)^4 \quad (20)$$

and $$\Delta Q=37 \text{ KJ}.$$

Equation (8) is derived and solved by inegrating equation (6) from t=0 to t=20 seconds for the worst case (maximum energy radiated), where $W_T$ (and therefore T) is constant in time. The decoy contains a small energy storage source that can supply several times the energy required by equation (8). This energy is used to keep the surface temperature of the decoy the same as if the decoy were a massive ICBM. This is accomplished by using two detectors. One determines the surface temperature of the decoy and the other, which is thermally insulated and is of very small thermal mass, determines the temperature of the space into which the decoy is radiating. The power being released by the device inside the decoy is proportional to this temperature difference. The sensor which measures the temperature of the space into which the decoy radiates may actually be multiple sensors if desired whose readings are averaged.

Figure 2:
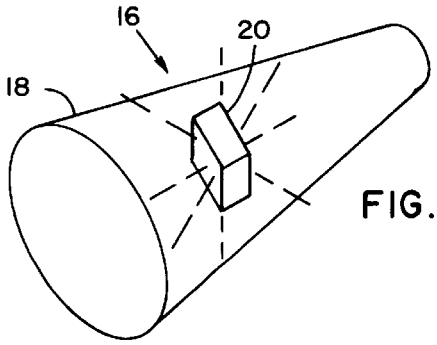
FIG. 2 is a perspective view of a heat generator within a decoy missile for simulating an ICBM.
Figure 3:
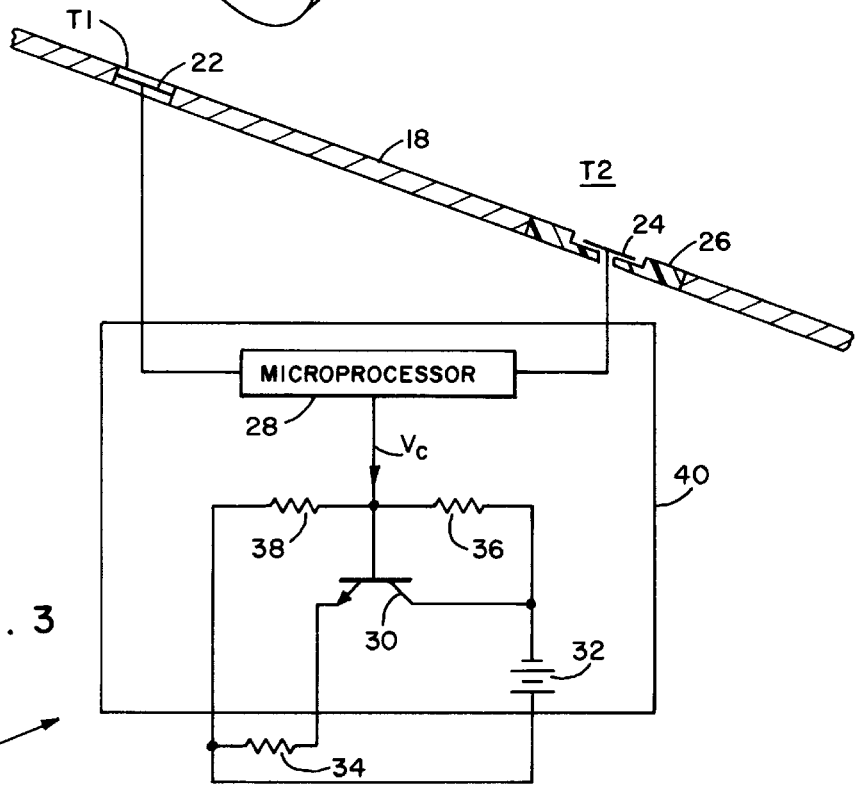
FIG. 3 is a schematic of a preferred embodiment of the heat generator system within the decoy.

As shown in FIG. 1, when the ICBM orbits or passes from the sun lit region into the shadow region, cooling takes place. FIG. 2 shows a ICBM radar decoy 16 which contains the thermal generator 20 to make it also a thermal decoy. Generator 20 generates and radiates thermal energy within housing 18 of decoy 16. FIG. 3 is a schematic illustration of the generator 20. The decoy 16 has a sensor 22 in the outer surface of housing 18 which measures the temperature of the outer surface and is in thermal contact with this surface. A sensor 24 is disposed in radiative thermal contact with outer space. Sensor 24 is mounted in housing 18 but is insulated from the outer surface of the decoy by the thermal insulator 26, which may be made of asbestos or other suitable material. The signals from these two sensors or sensor groups are coupled to a simple microprocessor 28 to produce an output voltage $V_c$ that is proportional to $(T_1-T_2)$, where $T_1$ is the temperature of surface 18 and $T_2$ is the temperature of outer space. This output voltage is then coupled as a bias to regulate the flow of current through a transistor valve 30. A direct current source 32 supplies negative voltage to the collector of transistor 30 and a positive voltage through load resistor 34 to the emitter of transistor 30. The current from source 32 causes $I^2R$ losses to be developed in the load. Resistors 36 and 38 are connected in common to the base of transistor 30 and to the input voltage $V_c$. Resistor 38 is further coupled to the positive output of source 32, and resistor 36 is coupled to the negative output of source 32 for developing transistor bias voltages. With the exception of sensors 22 and 24 and load resistor 34 the device is contained in a small insulated container 40 so that the heat generated in load 34 is not absorbed by the generator itself. Thus, the $I^2R$ losses are radiated into $4\pi$ steradians within the decoy. This energy is absorbed by the outer surface 18 and is reradiated to outer space over $4\pi$ steradians.

In operation, without the heat generator, the temperatures $T_1$ and $T_2$ sensed respectively by sensors 22 and 24 will rapidly become closer so that the difference therebetween goes to zero as the decoy cools. With the heat generator in operation the heater 34 may be used to heat surface 18 so that temperature $T_1$ is controlled to remain constant at the value it had in the sun lit region before entering the earth's shadow. Alternatively, it may be controlled to change gradually as if the decoys thermal mass were exactly the same as that of an ICBM. In the event that an ICBM is shrouded in a balloon and many like balloons (decoys), which do not contain ICBM's, are used so that all of the objects appear to a radar system as decoys, a thermal source can be placed in each balloon decoy to cause the balloon to change temperature, thereby appearing to a FLIR system as if it contained a massive ICBM.

Obviously sensors 22 and 24 can be single sensors or multiple sensors disposed in an array. For example, if a decoy is spinning or tumbling rapidly, one sensor will average the available spatial temperature. However, if the decoy is stable (not spinning or tumbling), several sensors, four or more, can be used to assure that the temperature readings are averaged and that a large area or space is sampled for each response time. Typically, temperature sensors may be thermocouples or a distributed thermopile.

Although a particular embodiment and form of this invention has been illustrated, it is apparent that various modifications and embodiments of the invention may be made by those skilled in the art without departing from the scope and spirit of the foregoing disclosure. For example, as is well established in the art, switching means such as a time delay circuit or a threshold circuit may be incorporated in container 40 to prevent the power source or microprocessor from operating until a predetermined time occurs or temperature difference occurs. Accordingly the scope of the invention should be limited only by the claims appended hereto.

I claim:

1. A method of providing a thermal decoy that is thermally massive across the entire black body spectrum comprising the steps of:

placing a decoy housing into an outer space environment, sensing the temperature of the outer surface of said housing, simultaneously sensing the temperature of the outer space environment adjacent said housing, combining the sensed temperatures to provide an output voltage difference signal therefrom for driving a current source, driving said current source to provide a current output to a resistance heater for generating heat, radiating said heat within said decoy housing, and re-radiating said heat from said housing into outer space.

2. A method of providing a thermal decoy as set forth in claim 1 wherein the steps of radiating and re-radiating are the directing of heat losses through $4\pi$ steradians.

3. A method of providing a thermal decoy as set forth in claim 2 and further comprising the steps of isolating said current source from said resistance heater so that heat radiated from said resistance heater is not absorbed by said current source.

4. In a missile system wherein an intercontinental ballistic missile and light weight decoy missile are launched into an outer space environment toward a target a method for causing the decoys to appear as thermal decoys providing the same radar cross-section as that of the intercontinental ballistic missile and comprising the steps of:

launching said missile along a polar orbital path, sensing the temperature of the outer surface of said decoy missile as a first temperature, simultaneously sensing the temperature of the outer space surrounding the decoy as a second temperature, providing first and second variable voltage outputs as a function of said first and second temperatures, combining said first and second voltages to provide a difference signal, supplying electrical power to a resistance heater within said decoy in response to said difference signal, and radiating heat from said heater to maintain the decoy outer surface at a temperature similar to that of said intercontinental ballistic missile.

5. Apparatus for providing a light weight decoy missile which simulates an intercontinental ballistic missile when launched into outer space along a polar orbital path, comrising: a light weight missile housing, sensing means disposed in the housing for measuring the temperature of the housing and for measuring surrounding exo-atmospheric temperature, processing means coupled to said sensing means for converting said temperature into equivalent voltages and providing a voltage output that is a function of the difference between the temperatures, heat generating means coupled to said processing means output for radiating heat within said decoy to maintain the decoy outer surface at a temperature commensurate with that of an intercontinental ballistic missile.

6. Apparatus as set forth in claim 5 wherein said sensing means comprises at least first and second temperature sensor circuits disposed within the surface of said housing, said first sensor circuit being embedded within and in contact with the housing for measuring the outer surface temperature of said housing, and said second sensor circuit being disposed recessed within said housing for measuring exo-atmospheric temperature.

7. Apparatus as set forth in claim 6 and further comprising insulating means disposed between said second sensor circuit and said housing.

8. Apparatus as set forth in claim 7 wherein said heat generating means comprises a resistance heater and a variable current source said current source being responsive to said processing means output voltage for supplying a current to said resistance heater.

* * * * *